US012781512B2

(12) United States Patent
Skupin

(10) Patent No.: US 12,781,512 B2
(45) Date of Patent: Nov. 3, 2026

(54) TILE FOR ROOF OR WALL

(71) Applicant: SKUPIN DESIGN GMBH, Kaarst (DE)

(72) Inventor: Frederick Skupin, Moenchengladbach (DE)

(73) Assignee: SKUPIN DESIGN GMBH, Kaarst (DE)

( * ) Notice: Subject to any disclaimer, the term of this patent is extended or adjusted under 35 U.S.C. 154(b) by 232 days.

(21) Appl. No.: 18/241,876

(22) Filed: Sep. 3, 2023

(65) Prior Publication Data

US 2024/0060312 A1 Feb. 22, 2024

Related U.S. Application Data

(63) Continuation of application No. PCT/EP2022/056697, filed on Mar. 15, 2022.

(30) Foreign Application Priority Data

Mar. 24, 2021 (DE) ..... DE102021107334.0

(51) Int. Cl.
*E04F 13/08* (2006.01)
*E04D 1/22* (2006.01)
*E04F 13/14* (2006.01)

(52) U.S. Cl.
CPC ..... *E04F 13/0864* (2013.01); *E04D 1/22* (2013.01); *E04F 13/14* (2013.01)

(58) Field of Classification Search
CPC ..... E04D 1/16; E04D 1/2916; E04D 1/2918; E04D 1/04; E04F 13/0864; E04F 13/0803; E04F 13/083
See application file for complete search history.

(56) References Cited

U.S. PATENT DOCUMENTS 1,370,716 A * 3/1921 Tromm ..... E04D 1/2918 52/550
1,590,744 A * 6/1926 Hatch ..... E04D 1/16 52/542
3,046,700 A * 7/1962 Davenport ..... E04F 13/0864 52/409

(Continued)

FOREIGN PATENT DOCUMENTS

DE 4402971 A1 8/1994
DE 102020113138 A1 7/2020

(Continued)

*Primary Examiner* — Brian E Glessner
*Assistant Examiner* — Daniel J Kenny
(74) *Attorney, Agent, or Firm* — Von Rohrscheidt Patents

(57) ABSTRACT

A sliding formwork brick for roof and/or façade cladding, the sliding formwork brick including a rectangular plate; an upper bar shaped reaction bearing arranged at a back side of the rectangular plate and extending over a width of the rectangular plate, wherein the upper bar shaped reaction bearing includes a support surface inclined at an angle α of 3° to 20° relative to a line oriented orthogonal to a plane of the rectangular plate, wherein the support surface extends to the back side of the rectangular plate, and wherein a contact surface adjoins the support surface at an angle β of 90° so that the support surface and the contact surface are configured to contact a rectangular cross lath of a lathing of the roof and/or façade cladding.

8 Claims, 3 Drawing Sheets

(56) References Cited

U.S. PATENT DOCUMENTS

| | | | | | |
|---|---|---|---|---|---|
| 4,262,464 | A | | 4/1981 | Ludowici | |
| 4,662,141 | A | * | 5/1987 | Miko | E04D 1/04 52/553 |
| 4,890,432 | A | * | 1/1990 | Shepherd | E04D 1/2916 52/542 |
| 4,914,885 | A | * | 4/1990 | Baker | E04D 1/2916 52/549 |
| 5,197,252 | A | * | 3/1993 | Tiscareno | E04D 1/3405 52/553 |
| 5,465,547 | A | * | 11/1995 | Jakel | E04D 1/04 106/608 |
| 6,928,781 | B2 | * | 8/2005 | Desbois | E04D 12/004 52/552 |
| 7,003,922 | B2 | * | 2/2006 | Fifield | E04D 1/16 52/302.1 |

FOREIGN PATENT DOCUMENTS

| | | | | | |
|---|---|---|---|---|---|
| EP | 2599930 | B1 | | 2/2016 | |
| EP | 3683379 | A1 | * | 7/2020 | E04F 13/0816 |
| WO | WO9919579 | A1 | | 4/1999 | |
| WO | WO2020177827 | A1 | | 9/2020 | |

* cited by examiner

TILE FOR ROOF OR WALL

RELATED APPLICATIONS

This application is a continuation of International Patent Application PCT/EP2022/056697 filed on Mar. 15, 2022 claiming priority from German Patent Application DE10 2021 107 334.0 filed on Mar. 24, 2021, both of which are incorporated in their entirety by this reference.

FIELD OF THE INVENTION

The invention relates to a sliding formwork brick.

BACKGROUND OF THE INVENTION

Sliding formwork bricks are hung or bolted on a ventilated substructure of a façade or a roof forming a superimposed façade including regulation type lathing and a superimposed cross lathing with an upper bar shaped reaction bearing at the cross lathing.

A sliding formwork brick described in EP 2 599 930 B1 includes a reaction bearing on its back side which is supported with its rear free edge in a line shape on a cross lath. According to FIGS. 8 and 9 of this printed document. The back side of this sliding formwork brick is only supported in a contact line at the cross lath as well.

A sliding formwork brick described in FIGS. 1 and 2 of DE 10 2020 113 138 A1 includes a lath support arm at an upper end of the sliding formwork brick adjoining a back side of the sliding formwork brick wherein the lath support arm has a relatively narrow support surface that is offset from the back side of the sliding formwork brick and oriented at a slant angle to a plate plane of the sliding formwork brick. According to FIG. 1 the back side of the sliding formwork brick, is only supported in a contact line at a cross lath C of the cross lathing.

In a known sliding formwork brick 1' shown in FIG. 1 of the instant application, the bottom side of the upper bar shaped reaction bearing 3' is oriented at a right angle to a plane of the plate 2' so that the free end of the upper reaction bearing 3' contacts the cross-lath C merely in a contact line.

This line shaped support has the effect that forces impacting the sliding formwork brick are only reacted in a disadvantageous manner for the sliding formwork bricks according to EP 2 599 930 B1 and DE 10 220 113 138 A1 as well. In order to achieve reliable static positioning of the brick 1' on the cross lath, the cross laths have a bevel Cl according to FIG. 1 at a front side so that the back side of the plate 2' contacts the beveled contact surface. The known system is disadvantageous, since a slanted bore hole has to be fabricated in the brick in order to screw the brick to the cross lath C which requires a rather complex fabrication process for bricks produced by line extrusion and causes reduced force transmission due to the slanted positioning of the screw. Fabricating the bevel at the cross lath requires an additional step in the production of the cross laths.

BRIEF SUMMARY OF THE INVENTION

Thus, it is an object of the invention to provide an improved sliding formwork brick to achieve optimum force flow and optimum support for the sliding formwork brick.

The object is achieved by a A sliding formwork brick for roof and/or façade cladding, the sliding formwork brick including a rectangular plate; an upper bar shaped reaction bearing arranged at a back side of the rectangular plate and extending over a width of the rectangular plate, wherein the upper bar shaped reaction bearing includes a support surface inclined at an angle $\alpha$ of 3° to 20° relative to a line oriented orthogonal to a plane of the rectangular plate, wherein the support surface extends to the back side of the rectangular plate, and wherein a contact surface adjoins the support surface at an angle $\beta$ of 90° so that the support surface and the contact surface are configured to contact a rectangular cross lath of a lathing of the roof and/or façade cladding.

This provides reliable support and positioning of the sliding formwork bricks on the rectangular cross laths by the support surface contacting the cross lath flat and on the other hand side by the contact surface contacting the cross lath flat laterally.

According to an advantageous embodiment of the invention the support surface has a width of at least 15 mm and the contact surface has a width of at least 30 mm.

BRIEF DESCRIPTION OF THE DRAWINGS

The invention is subsequently described in more detail with reference to drawing figures, wherein.

DETAILED DESCRIPTION OF THE INVENTION

Figure 1:
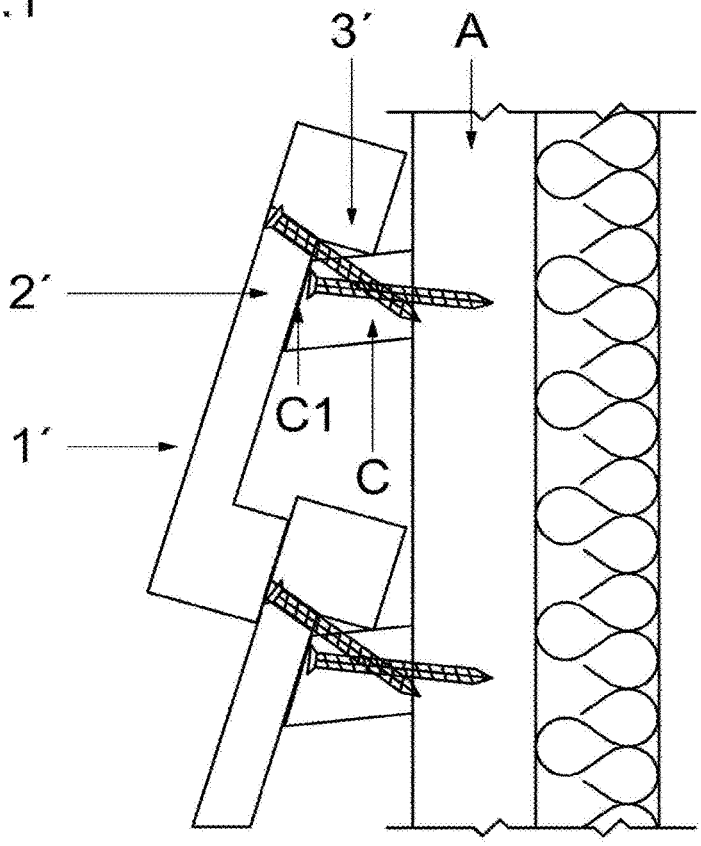
FIG. 1 PRIOR ART
FIG. 1 illustrates a partial side view of a façade cladding including known sliding formwork bricks applied to cross laths C.
Figure 2:
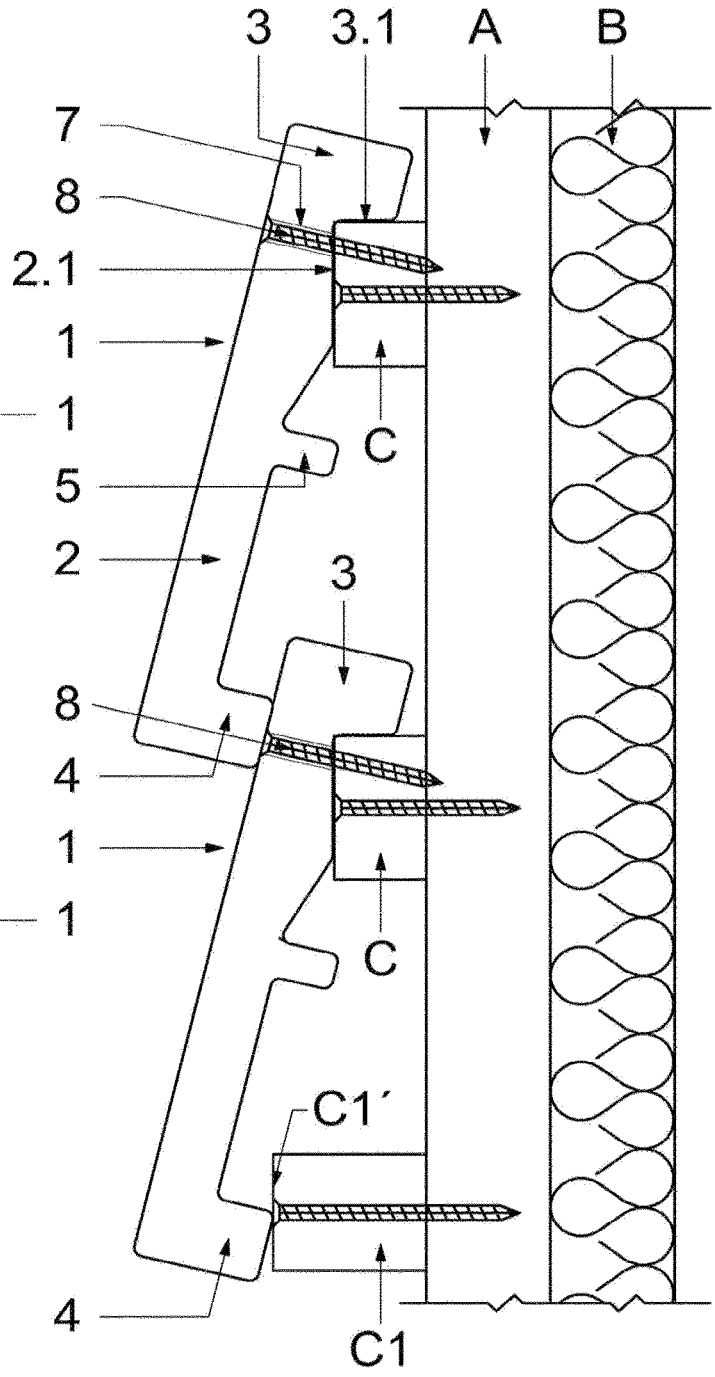
FIG. 2 illustrates a side view of the sliding formwork brick according to the invention.
Figure 4:
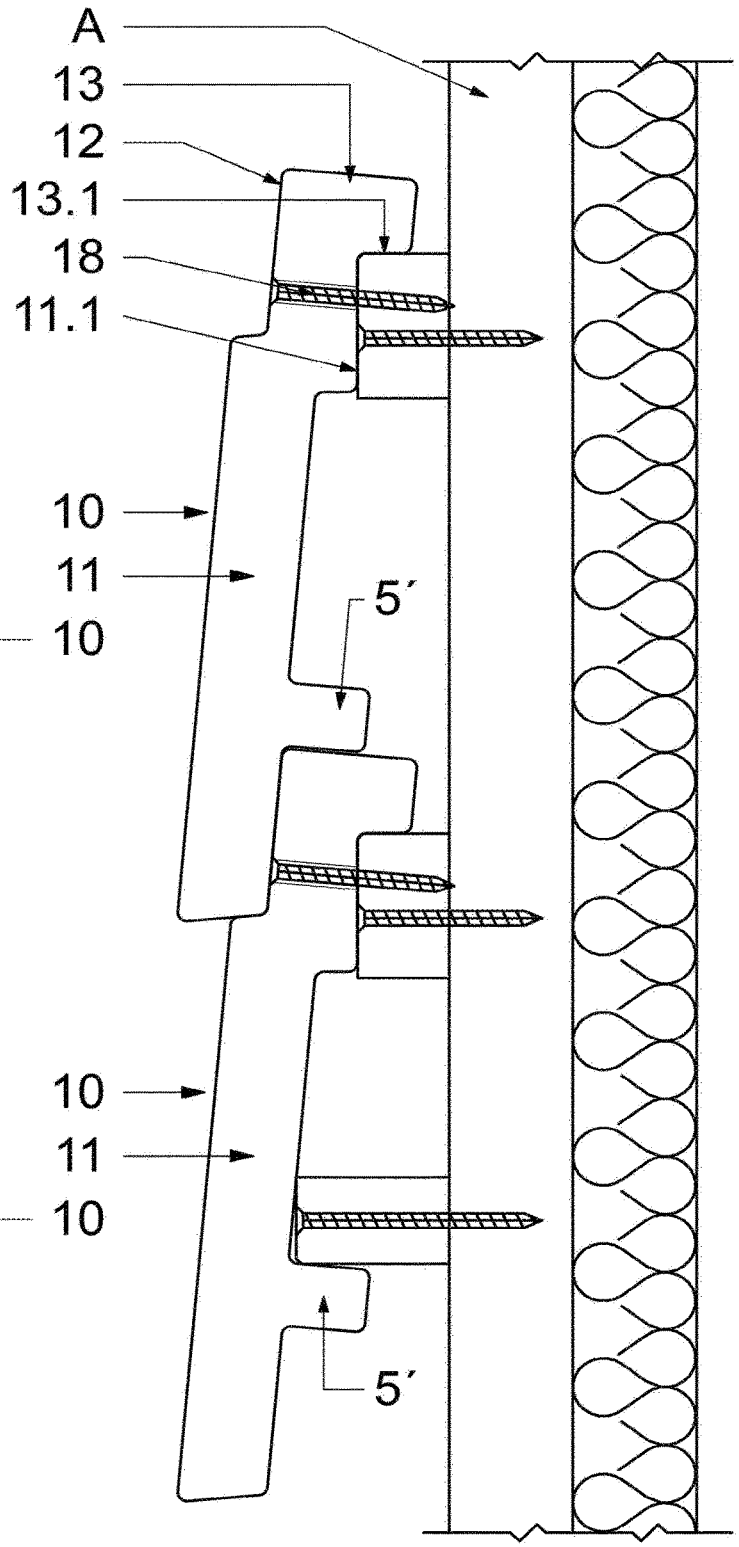
FIG. 4 illustrates a side view of the sliding formwork brick forming part of the façade cladding.

FIGS. 1, 2 and 4 show a vertical lath A that includes cross laths C screwed down thereon wherein the vertical lath A contacts an insulation layer B of a roof or a façade wall.

The known sliding formwork brick 1' illustrated in FIG. 1 includes a plate 2' wherein upper and lower rectangular reaction bearings 3' and 4' are formed at a back side of the plate 2'. The upper bar shaped reaction bearing 3' is supported in a contact line on the cross lath C. The cross lath C includes two side surfaces that are arranged at a right angle relative to each other and a side surface Cl oriented at a slant angle and forming a contact surface for the back side of the plate 2'.

In the sliding formwork brick 1 according to the invention illustrated in FIG. 2, the upper bar shaped reaction bearing 3 has a lower support surface 3.1 that is oriented at a slant angle relative to the plate 2, wherein a contact surface 2.1 adjoins the support surface 3.1 at the back side of the plate 1 at a right angle, so that the sliding formwork brick 1 is supported with its support surface 3.1 on the cross lath C and contacts the cross lath C with the contact surface 2.1.

Figure 6:
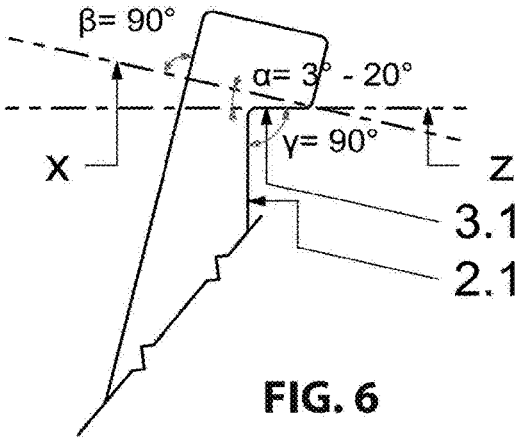
FIG. 6 illustrates a detail view of the sliding formwork brick shown in FIG. 2.

The support surface 3.1, represented by the line z, in FIG. 6 is inclined relative to the line x oriented orthogonal to the plane of the plate 2 at an angle $\alpha$ of 3° to 20°

Advantageously the angle $\alpha$ is between 10° to 15°, particularly advantageously between 12° and 14°.

The support surface 3.1 contacting the cross lath C advantageously has a width of at least 15 mm.

The contact surface contacting the cross lath C, advantageously has a width of at least 30 mm.

A reinforcement rib 5 is formed between the upper protrusions 3 and the lower protrusion 4 at an inside of the plate 2, wherein an end of the reinforcement rib is in an identical plane with the ends of the protrusions 3 and 4 in order to prevent a sagging of the plate 1 during line extrusion of the sliding formwork brick 1 and subsequent transporting of blanks to a firing station.

The sliding form work brick 1 includes at least one hole 7 oriented, orthogonal to a plane of the plate 1 for an attachment element from a group including screws 8 or nails.

The invention furthermore relates to a sliding formwork brick 10 for roof and façade cladding, comprising:

a) a rectangular plate 11, b) a recess 12 arranged at an upper end of a front side of the plate 11 and extending over a width of the plate and configured to receive a respective lower end of a sliding formwork brick 10 arranged above in a finished cladding, c) wherein a depth of the recess 12 orthogonal to the plate plane is smaller than a thickness of the plate 11; and d) an upper bar shaped support 13, arranged at a plate backside.

Figure 7:
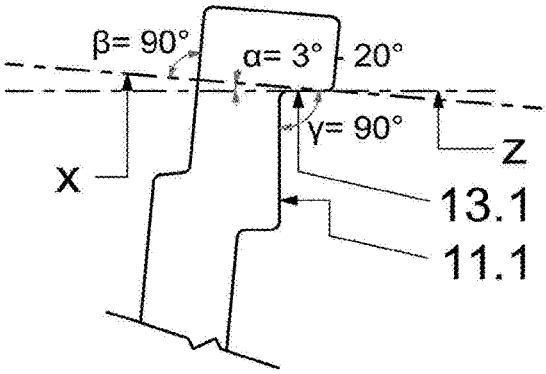
FIG. 7 illustrates a detail view of the sliding formwork brick shown in FIG. 4.
Figure 3:
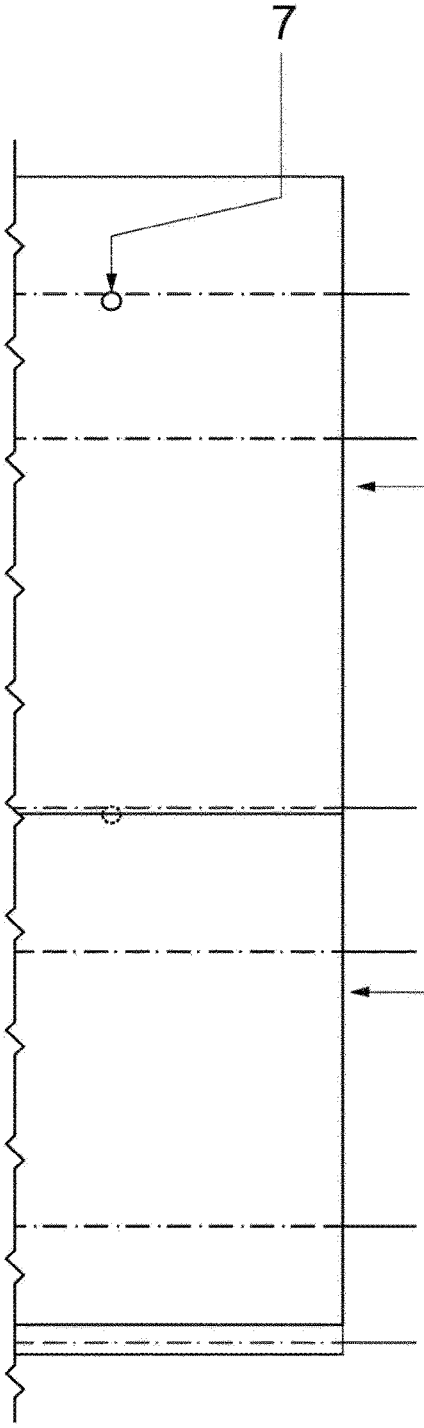
FIG. 3 illustrates a front view of the façade cladding.

As illustrated in FIG. 7, the sliding formwork brick 10 is characterized in that e) the upper reaction bearing 13 includes a support surface 13.1 that is inclined at an angle α of 3° degrees to 20° relative to a line x that is orthogonal to a plane of the plate, f) wherein a contact surface 11.1 adjoins the support surface 13.1 at an angle β=90° degrees so that the support surface 13.1 and the contact surface 11.1 are configured to contact a rectangular cross-lath C of the lathing of the roof or façade cladding.

Advantageously the angle α in a sliding formwork brick is between 3° and 9° in particular a is between 4° and 6°.

Figure 5:
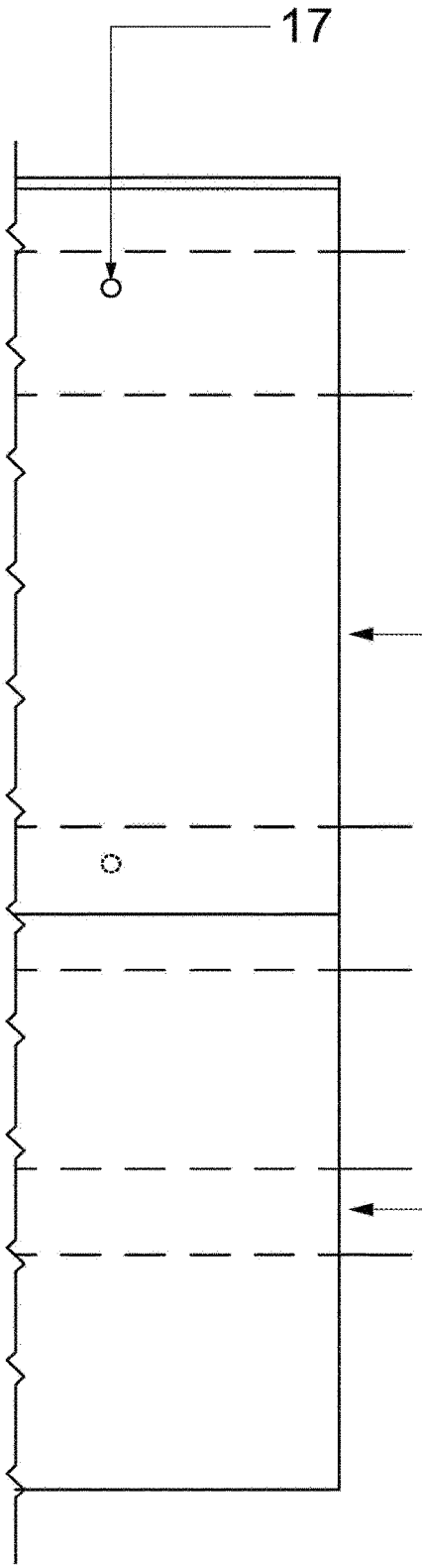
FIG. 5 illustrates a front view of the façade cladding illustrated in FIG. 4.

The sliding formwork brick 10 illustrated in FIGS. 4 and 5 also includes a hole 17 arranged orthogonal to a plane of the plate, e.g. for a screw 18, and a stiffening rib. The support surface 13.1 advantageously has a width of at least 15 mm, the contact surface 11.1 advantageously has a width of at least 30 mm.

What is claimed is:

1. A tile arrangement of a roof or wall, the tile arrangement comprising:

a rectangular plate made from fired brick, and including a front side and a backside;

an upper bar shaped reaction bearing arranged at the back side of the rectangular plate and extending over a width of the rectangular plate and including a flat contact surface and a flat support surface oriented perpendicular to the flat contact surface;

a lathing mounted to the roof or wall and including a rectangular cross lath including a front side oriented towards the flat contact surface;

a hole arranged in the rectangular plate orthogonal to the front side of the rectangular plate; and a fastener inserted into the hole and driven at an angle of less than 90° into the front side of the rectangular cross lath in a contact area of the flat contact surface of the rectangular plate and the front side of the cross lath, wherein the flat support surface is inclined at an angle α of 3° to 20° relative to a line oriented orthogonal to the front side of the rectangular plate, wherein the flat support surface extends to the back side of the rectangular plate, and wherein the flat support surface and the flat contact surface contact two flat surfaces of the rectangular cross lath of the lathing of the roof and/or wall.

2. The tile arrangement according to claim 1, wherein the angle α is 10° to 15°.

3. The tile arrangement according to claim 2, wherein the angle α is 12° to 14°.

4. The tile arrangement according to claim 1, wherein the support surface has a width of at least 15 mm.

5. The tile arrangement according to claim 1, wherein the contact surface has a width of at least 30 mm.

6. The tile arrangement according to claim 1, further comprising:

a reinforcement rib arranged between the upper bar shaped reaction bearing and a lower reaction bearing at an inside of the tile, and wherein a height of the reinforcement rib orthogonal to the front side of the rectangular plate is equal to a height of the upper bar shaped reaction bearing and the lower reaction bearing.

7. The tile arrangement for the roof or wall according to claim 1, wherein the flat contact surface is oriented parallel to the roof and/or wall and the flat support surface is oriented perpendicular to the roof and/or wall.

8. The tile arrangement according to claim 1, wherein the flat contact surface is oriented vertical and the flat support surface is oriented horizontal.

* * * * *